United States Patent [19]

Morrow et al.

[11] Patent Number: 4,863,094

[45] Date of Patent: Sep. 5, 1989

[54] TWO PIECE TRAY

[76] Inventors: Marvin D. Morrow, 7763 Tamarack Dr., Dublin, Calif. 94568; Michael S. Bisbiglia, 886 Begonia Dr., San Leandro, Calif. 94578

[21] Appl. No.: 229,325

[22] Filed: Aug. 8, 1988

[51] Int. Cl.[4] ..... B65D 1/34

[52] U.S. Cl. ..... 229/125.03; 206/518; 206/519; 206/562; 220/94 R; 229/904; 229/117.09

[58] Field of Search ..... 229/1.5 H, 2.5 R, 114, 229/125.01, 125.03, 125.35, 125.02, 52 A, 52 AL, 904, 906; 206/518, 519, 562, 563, 565; 220/306, 307, 94 R

[56] References Cited

U.S. PATENT DOCUMENTS

| | | | |
|---|---|---|---|
| 2,780,401 | 2/1957 | Stevens | 229/2.5 R |
| 2,814,427 | 11/1957 | Emery | 229/2.5 R |
| 3,233,812 | 2/1966 | Kennedy | 206/518 |
| 3,349,950 | 10/1967 | Wanderer | 220/307 |
| 3,351,265 | 11/1967 | Miller | 229/2.5 R |
| 3,749,276 | 7/1973 | Davis | 220/306 |
| 3,842,975 | 10/1974 | Chang | 220/307 |
| 4,373,642 | 2/1983 | Welters et al. | 220/307 |
| 4,456,164 | 6/1984 | Foster et al. | 229/125.35 |
| 4,497,433 | 2/1985 | Wischusen, III | 206/562 |
| 4,757,937 | 7/1988 | Maio et al. | 206/562 |

FOREIGN PATENT DOCUMENTS

| | | | |
|---|---|---|---|
| 488655 | 12/1953 | Canada | 206/562 |
| 503140 | 5/1954 | Canada | 220/94 R |
| 2641804 | 3/1978 | Fed. Rep. of Germany | 220/94 R |
| 2589438 | 5/1987 | France | 220/306 |

OTHER PUBLICATIONS

"Distribution Packaging" by Walter Friedman and Jerome Kipnees, Robert E. Krieger publishing Co., 1977, pp. 63–65.

*Primary Examiner*—Gary Elkins

*Attorney, Agent, or Firm*—Glen R. Grunewald; Thomas R. Lampe

[57] ABSTRACT

A nestable, two-part tray including a lower part having tapered side walls and a bottom made of waterproof material, having an open top surrounded by a shoulder and having a vertically standing rim connected to the outer extremity of the shoulder, the second part of the tray being a flat element such as corrugated cardboard having dimensions such that it fits within the rim and has its edges resting on the shoulder.

12 Claims, 1 Drawing Sheet

TWO PIECE TRAY

TECHNICAL FIELD

This invention is in the field of trays that are particularly useful for carrying food and drinks and holding them while they are being consumed.

BACKGROUND ART

Fast-food restaurants normally serve food from a counter and consumers must carry the food to the place where it is consumed. Food purchased in fast-food restaurants is frequently consumed in a vehicle which may be traveling across the highway while the food is being eaten. Many fast-food restaurants provide trays for their customers to carry food to a table within the restaurant or to a vehicle in which it is to be consumed. The trays normally are light weight and disposable and the food is also served in light weight and disposable containers such as paper or plastic drinking containers and paper or plastic plates or dishes. As a result, the food containers tend to slip on the surface of the carrying tray and beverage containers tend to tip over. Persons who purchase and carry food served in fast-food restaurants are not skilled food servers and persons who eat fast food having serving trays precariously perched on their laps are frequently children.

Disposable trays for carrying and eating fast food must be inexpensive to make and easy to store and use. Flat trays are both inexpensive to make and easy to store and use but flat trays are undesirable for the reasons mentioned above. Deep trays that are capable of containing food and holding the contents of tipped-over drink containers are difficult to store and use because they consume so much vertical space. A stack of six, 4-inch deep trays would consume 2 feet vertically on a shelf. Trays made to be nested are frequently used to avoid the problem of consuming vertical storage space however nested trays tend to jam together making it difficult to separate them one from another as they are being used. The time consumed in separating a single top tray from a stack of jammed trays is not acceptable in a busy fast-food restaurant.

Deep trays also suffer from having food and drink items not easily accessible. To avoid inaccessibility 2-piece trays have been made having a deep lower part and a flat upper part. Such trays must be assembled before use, but the assembly of upper and lower pieces cannot consume too much time. Additionally, the assembled unit should not easily come apart in use or the benefits obtained from the food holding upper tray part are lost.

It has also been known to make trays for fast food of folded cardboard so that the trays may be made and stored flat and folded to make three-dimensionable shapes at the site where they are to be used. Trays made of flat cardboard elements that are folded to produce depth almost invariably have cuts and slits through which liquid that is spilled on such a tray can leak, whether the tray is deep or shallow. Additionally, liquid spilled on trays made of such materials as folded corrugated cardboard will quickly soak through the tray and soil the car upholstery or the clothing of the user who is, for example, holding the tray on his or her lap while the food is being consumed.

DISCLOSURE OF THE INVENTION

This invention is a two-part tray that is particularly suitable for serving and consuming fast food and beverage. The tray of this invention avoids or greatly diminishes the abovenoted problems associated with such trays.

The tray of this invention is a two-piece tray having an upper part and a lower part. The lower part is a deep, continuous part that preferably is waterproof. The term continuous means that the lower part of the tray has no slits, openings, or folds such as those that are found in three-dimensionable articles that are made from cut, flat cardboard that is folded and held in place with tabs or glue. The preferred material for the lower part of the tray of this invention is similar to the material from which egg cartons are made. It is manufactured by drawing a slurry of fibers through a filter that is in the shape of a desired object. The process results in a seamless object that is in the form of the filter, the object being a continuous matted fiber object. Matted fiber objects made in this manner can be made waterproof by known techniques, such as by treating the interior surface of the object with waterproofing compositions. Objects made in this manner can also be made with at least one side smooth.

The lower part of the tray of this invention has a flat bottom and an upper opening into which the upper part of the tray is assembled. The side walls of the lower part taper inwardly and the open top is surrounded by an upstanding rim that has vertical walls. In this description and the following claims, terms such as top, bottom, vertical and horizontal which deal with the spacial orientation of the trays are used in the context of the tray in its normal position during use.

The upstanding rim surrounding the upper opening of the lower part of the tray has sidewalls that are vertical and these sidewalls perform a number of important functions. The vertical rim interacts with the flat upper part of the tray to hold it in a horizontal plane and, as will be described below, to lock it in place against accidental displacement from the lower part. The rim also prevents nested lower parts from jamming so that the uppermost lower part in a stack of nested lower parts may be lifted from the stack individually without being jammed into any other lower part in the stack.

The upper part of the tray of this invention is preferably a planar shape of a size to fit within the rim of the lower part but to rest on a shelf-like shoulder formed between the rim and the uppermost part of the tapering sidewalls. The rim preferably includes inwardly extending projections placed above the shoulder a distance slightly greater than the thickness of the planar upper part. The planar upper part, by virtue of its flat shape, is flexible enough to be sprung beneath the projections and to snap into a locked-in position by exerting a small hand force in the center of the upper part. The upper part may be made of the same material as the lower part or of other material such as corrugated cardboard. It is easily formed from a single flat piece, easily shipped, easily stored, and easily assembled into the lower part at the site where food is served. Preferably, the upper parts are provided with one or more openings to hold drinking vessels and items such as tableware. They also may be fitted with indentations to hold dishes or other objects. The surrounding rim of the lower part prevents items such as tableware and food containers from sliding from the upper surface of the upper part and prevents spilled liquids from escaping the confines of the tray because spilled liquids will be diverted into the lower part by the portion of the rim standing above the upper part.

BEST MODE FOR CARRYING OUT THE INVENTION

Figure 1:
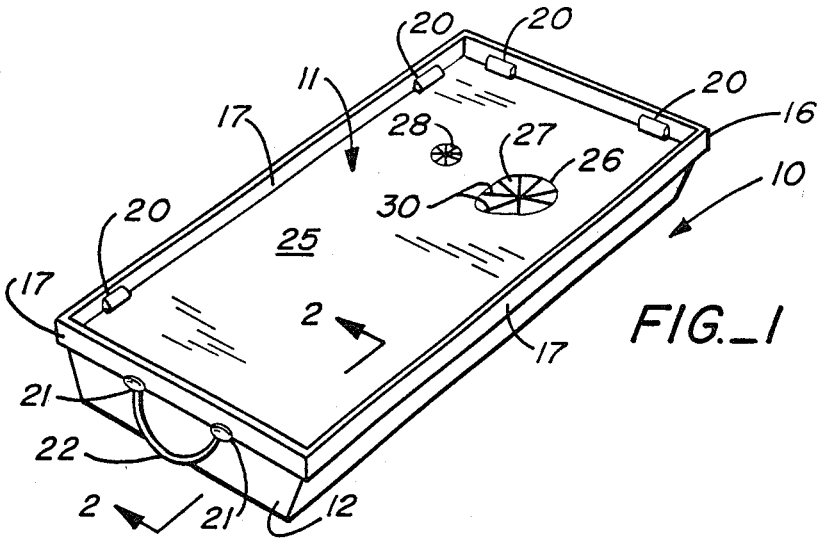
FIG. 1 is a perspective view of a device embodying this invention.
Figure 2:
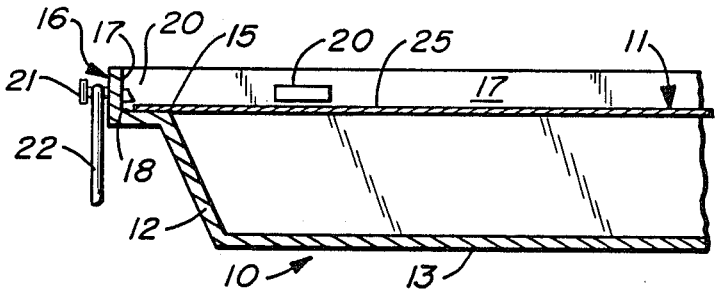
FIG. 2 is a partial cross section along the plane of the line 2—2 of FIG. 1.

The embodiment of this invention illustrated in FIGS. 1 through 6 shows a two-piece tray having a lower part generally designated 10 and an upper part generally designated 11. Lower part 10 has tapered sidewalls 12 and a flat bottom 13. All four of the sidewalls 12 must be tapered inwardly toward the bottom 13.

The flat bottom and tapered sidewalls of lower part 10 are continuous in the sense that the tapered sidewalls and bottom have no slits or seams through which liquid can escape. Preferably, the tapered sidewalls 12 and flat bottom 13 are formed of a mat of cellulose fibers such as the matted fiber products used for egg cartons. At least the outer portion of the tapered sidewall and flat bottom preferably are smooth so that the outer portion of the sidewalls and bottom are available for printing and advertising and the flat bottom is suitable as a writing surface if the tray is inverted and used for that purpose. It is also preferred that the interior surface of the tapered sidewall be treated with waterproofing material so that the vessel formed of the tapered sidewalls 12 and flat bottom 13 is capable of containing liquid which will not leak through cracks or slits and which will not soak through the walls or the bottom of the container.

The open top 15 is surrounded with a rim generally designated 16. The rim 16 has a vertical wall 17 which is connected to the tapered sidewalls 12 through a horizontal shoulder 18. It is essential to this invention that wall 17 is substantially vertical and that it be connected to tapered sidewall 12 with a shoulder 18.

In a preferred embodiment of the invention projections 20 extend inwardly from the interior surface of vertical wall 17. The lower extreme of projections 20 is spaced above shoulder 18 a distance that is slightly greater than the thickness of upper part 11. In the illustrated embodiment there are two projections 20 extending inwardly from each of the vertical walls 17. More or fewer projections may be employed however, if projections are to be employed in the tray of this invention at least two should be used and they should be on opposite walls.

Another preferred embodiment of the invention is to provide knobs 21 extending from the exterior surface of walls 17. Knobs 21 preferably are used in pairs and are on only two opposite walls of rim 16, and these, preferably, are on the shorter of the opposite walls if the shape of lower part 10 is rectangular. If knobs 21 are employed, a carrying strap 22 may be employed with them in order to facilitate carrying the tray, for example by using straps 22 as handles or by using straps 22 to attach to a longer strap that can be carried behind the neck of a user.

It is preferred that the entire lower part 10, except for knobs 21, be made of a single, unitary piece of material. However, it is only necessary that the tapered sidewalls 12 and the flat bottom 13 be made of a single, unitary piece of material. The rim 16 may be a separate piece attached to the shoulder 18 by glue or other means because the rim need not contain liquid but only divert its direction of flow toward tapered sidewalls 12 and flat bottom 13. Additionally, the rim 16 need not be made of the same material as the remaining portions of the bottom part although it is preferred that it be made of such material. Projections 20 preferably are formed of the same material as rim 16 and formed integrally with rim 16 although projections 20 may be made of different material and may be assembled, such as by gluing after rim 16 is formed and installed on the lower part 10.

Knobs 21 generally must be made so they are not unitary with rim 16 but are installed later either by gluing or other suitable attachments. Knobs 21 preferably have a necked down portion so that a carrying strap will be held securely on the knobs.

Figure 4:
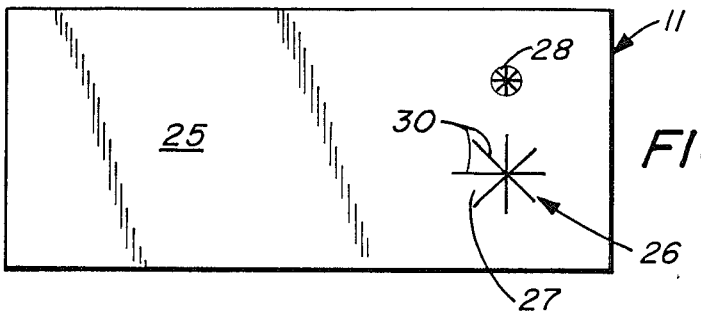
FIGS. 4 and 5 are, respectively, a plan view, and an elevation view of an upper part of a device embodying this invention.
Figure 5:
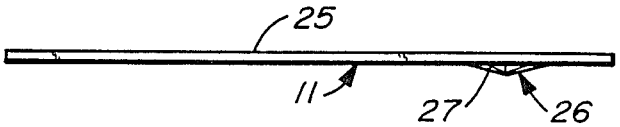

Upper part 11 may be made of a single cut piece of matted fibers or corrugated cardboard or of any other material that is stiff enough to bridge across the opening of lower part 10 and hold food securely on its upper surface. Upper part 11 has a planar upper surface 25 and is preferably provided with a drinking receptacle holder 26 for holding receptacles containing liquids. The receptacle holder 26 preferably is provided with flexible fingers 27 which may readily be formed in materials such as corrugated cardboard by a number of radial slits through the upper part that extend a distance greater that the radius of any drinking receptacle. Radial slits about 1.5 inches long will accommodate most drinking vessels. Such a receptacle holder permits the drinking receptacle to stand on the flat bottom 13 and to be held against tipping by the flexibility of triangular fingers 27 which are formed by the radial cuts through upper part 10. In the illustrated embodiment three slits 30 are longer than the others and they provide space to accept a handle of a cup without interfering with the stability with which any drinking vessel is held. A utility holder 28 for such things as tableware may also be formed in the same manner, utility holder being formed in the same way but having smaller diameter than the drinking receptacle holder. The upper part of the tray of this invention is illustrated in FIGS. 4 and 5.

INDUSTRIAL APPLICABILITY

Figure 3:
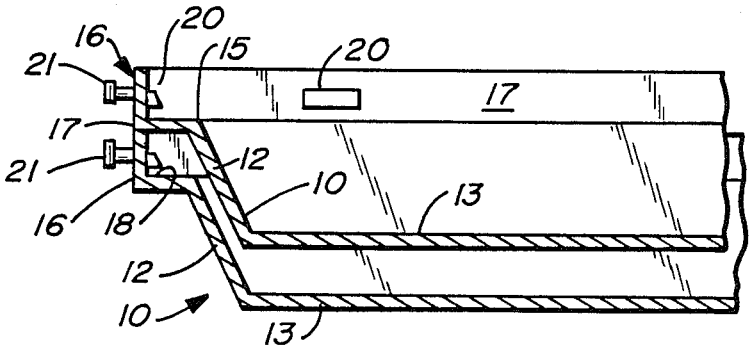
FIG. 3 is a cross section similar to FIG. 2 showing two, nested lower parts of devices embodying this invention.

As best illustrated in FIG. 3, trays made in accordance to this invention may readily be stacked without jamming. Each of the nested trays has its surrounding rim in contact with the surrounding rim of the next lower and the next higher surrounding rim. The rims abut one another but they prevent tapered sidewalls 12 from coming in contact with one another. In addition, the rims space one nested tray from another in a manner such that projections 20 are accommodated within the stack without interfering with nesting of trays and without being crushed or otherwise coming in contact with any portion of an adjacent tray. The rims 16 also prevent knobs 21 from coming in contact with one another when a number of lower parts are nested and stacked. If rims 16 stand above shoulders 18 a distance of $\frac{3}{4}$ inch, then a stack of twenty-four trays will consume only eighteen inches of vertical space plus the depth of a lower part between shoulder 18 and flat bottom 13. Nested lower parts may be removed from the stack by simply lifting the uppermost lower part 10 which can easily be lifted vertically without jamming against the next lower tray or otherwise interfering with the ability to separate that lower part from the stack of lower parts.

Upper parts 11, of course, stack compactly because they are all flat pieces.

In use, a worker in a fast-food restaurant, for example, may take an order that includes food and beverage. The order may be served by removing the uppermost lower part 10 from a stack of lower parts, removing the uppermost upper part 11 from a stack of upper parts, placing the upper part 11 within the confines of rim 16 and exerting hand force downwardly at approximately the center of upper part 11 whereby the flexibility of upper part 11 will cause the edges of it to snap beneath extensions 20 thereby locking it in place within the rim of the lower part. A container of food placed on upper part 25 may be carried as it would be carried on any tray except that it will be prevented from sliding off of upper part 11 by the surrounding rim 16. A beverage container full of beverage may be positioned over receptacle holder 26 and gently pushed downwardly whereupon flexible fingers 27 will separate enough to permit the beverage container to pass through upper part 11 a sufficient distance for the bottom of the beverage container to stand on flat bottom 13, but the flexibility of fingers 27 is such that they will urge the beverage container toward a central position within receptacle holder 26 and prevent it from moving relative to the tray itself when the tray is carried from one position to the other. If the beverage container has a handle, the container should be oriented with the handle facing longer radial slits which will accommodate a handle extending beyond the diameter of a cup. Flexible fingers 27 also will permit the beverage container to be removed from and replaced in receptacle holder 26 while the beverage is consumed. Upper part 11 may also have special holes, indentations or fittings to accommodate it to hold and receive other specific articles to be carried on the tray. Upper part 11 may also provide a medium for advertising, instructions or other indicia to make the tray of this invention more useful.

Additionally, although the features and characteristics of the two-piece tray of this invention particularly adapt it for use as a disposable tray, the tray may be made of more durable materials such as plastic. The tray is easily assembled and disassembled and is therefore susceptible to being cleaned and reused indefinitely if it is made of materials adapted for cleaning and reuse.

What is claimed is:

1. A two-piece tray comprising a lower part having four side walls all of which taper to converge downwardly, a bottom, an open top, a shoulder extending outwardly from said open top and a rim surrounding said open top, said rim having vertical walls extending above said shoulder and being connected to said shoulder adjacent the outer edge thereof, said tapered side walls and flat bottom comprised of continuous material;

a stiff, bendable upper part having a planar surface and having at least one dimension, perpendicular to an edge thereof, that is greater than the corresponding dimension of said open top and less than the corresponding dimension of said rim, said upper part including a receptacle holder comprised of radial slits at least 1.5 inches long.

2. The tray of claim 1 wherein said lower part is comprised of matted fibers.

3. The tray of claim 2 wherein said lower part is waterproof.

4. The tray of claim 2 wherein said lower part has a smooth side facing out.

5. The tray of claim 1 wherein said rim includes inward projections spaced above said shoulder a distance at least as great as the thickness of said upper part.

6. A tray of claim 5 including at least two of said projections with one on each of opposite sides of said rim.

7. The tray of claim 1 wherein the height of said rim above said shoulder is less than one inch.

8. The tray of claim 1, said rim having a knob extending outwardly from each of two opposite sides thereof.

9. The tray of claim 1, said shoulder being continuous with said side walls.

10. The tray of claim 1 wherein said rim is continuous with said shoulder.

11. The tray of claim 1 wherein said upper part is comprised of corrugated cardboard.

12. The tray of claim 1 wherein at least two of said radial slits are longer than the other radial slits.

* * * * *